US009959831B1

(12) United States Patent
Chen et al.

(10) Patent No.: US 9,959,831 B1
(45) Date of Patent: May 1, 2018

(54) DRIVE METHOD OF LIQUID CRYSTAL DISPLAY PANEL AND DRIVE SYSTEM OF LIQUID CRYSTAL DISPLAY PANEL

(71) Applicant: Shenzhen China Star Optoelectronics Technology Co., Ltd., Shenzhen (CN)

(72) Inventors: Yinhung Chen, Shenzhen (CN); Yu Wu, Shenzhen (CN); Anle Hu, Shenzhen (CN)

(73) Assignee: SHENZHEN CHINA STAR OPTOELECTRONICS TECHNOLOGY CO., LTD., Shenzhen, Guangdong (TW)

( * ) Notice: Subject to any disclaimer, the term of this patent is extended or adjusted under 35 U.S.C. 154(b) by 214 days.

(21) Appl. No.: 15/105,567

(22) PCT Filed: Apr. 12, 2016

(86) PCT No.: PCT/CN2016/079012

§ 371 (c)(1),
(2) Date: Jun. 17, 2016

(87) PCT Pub. No.: WO2017/152462

PCT Pub. Date: Sep. 14, 2017

(30) Foreign Application Priority Data

Mar. 11, 2016 (CN) ..... 2016 1 0140499

(51) Int. Cl.
*G09G 3/36* (2006.01)

(52) U.S. Cl.
CPC ... *G09G 3/3677* (2013.01); *G09G 2310/0251* (2013.01); *G09G 2320/0257* (2013.01)

(58) Field of Classification Search
CPC ..... G09G 3/3696
See application file for complete search history.

(56) References Cited

U.S. PATENT DOCUMENTS

2014/0091994 A1* 4/2014 Lin ..... G09G 3/348 345/87

* cited by examiner

*Primary Examiner* — Robin Mishler
(74) *Attorney, Agent, or Firm* — Leong C. Lei

(57) ABSTRACT

The present invention provides a drive method of a liquid crystal display panel and a drive system, in which a sequence controller (3) comprises a counter (31), a TFT activation voltage calculation module (32) and an I2C instruction module (33), and the counter (31) adds 1 as outputting the display data of each row, and as adding to i×M/N, the TFT activation voltage calculation module (32) operates to obtain the target TFT activation voltage of the i+1th gate drive IC (GD(i+1)) and transmits the same to the I2C instruction module (33), and the I2C instruction module (33) controls the PWM IC (2) correspondingly output the corresponding target TFT activation voltage to the i+1th gate drive IC (GD(i+1)), which can adjust the TFT activation voltage in real time so that the TFT activation voltages, which the respective gate drive ICs actually receive are consistent.

10 Claims, 4 Drawing Sheets

DRIVE METHOD OF LIQUID CRYSTAL DISPLAY PANEL AND DRIVE SYSTEM OF LIQUID CRYSTAL DISPLAY PANEL

FIELD OF THE INVENTION

The present invention relates to a liquid crystal display field, and more particularly to a drive method of a liquid crystal display panel and a drive system of a liquid crystal display panel.

BACKGROUND OF THE INVENTION

The LCD (Liquid Crystal Display) possesses many advantages of being ultra thin, power saved and radiation free. It has been widely utilized in, such as LCD TVs, mobile phones, Personal Digital Assistant (PDA), digital cameras, laptop screens or notebook screens, and dominates the flat panel display field.

Most of the liquid crystal displays on the present market are backlight type liquid crystal displays, which comprise a liquid crystal display panel and a backlight module. The working principle of the liquid crystal display panel is that the Liquid Crystal is injected between the Thin Film Transistor Array Substrate (TFT array substrate) and the Color Filter (CF). The light of backlight module is refracted to generate images by applying driving voltages to the two substrates for controlling the rotations of the liquid crystal molecules.

The liquid crystal display panel comprises a plurality of sub pixels aligned in array. Each pixel is electrically coupled to one thin film transistor (TFT). The Gate of the TFT is coupled to a horizontal gate scan line, and Source of the TFT is coupled to a vertical data line, and the Drain is coupled to the pixel electrode. The enough voltage is applied to the gate scan line with the Gate driver IC, and all the TFTs electrically coupled to the gate scan line are activated. Thus, the signal voltage on the data line can be written into the pixels to control the transmittances of the liquid crystals and to realize the display result.

With the development of the display technology, the dimension of the liquid crystal panel becomes larger and larger, and the resolution gets higher and higher. Generally, the liquid crystal display panel relies on the Pulse-Width Modulation (PWM) IC to produce a constant TFT activation voltage (VGH) for the gate driver IC to drive the TFTs in the sub pixels of respective rows, and then it is possible to charge the sub pixels. As shown in FIG. 1, the drive system of the liquid crystal display panel according to prior art comprises a liquid crystal display panel 100, a plurality of gate driver IC GD10, GD20, GD30, and etc. The constant TFT activation voltage VGH is generated by the PWM IC on the Printed Circuit Board Assembly (PCBA), and is transmitted to the respective gate driver ICs through the Wire On Array (WOA) located on the TFT array substrate. Because the WOA is thinner and the resistance is larger, the TFT activation voltage VGH will decay, and the TFT activation voltages VGH which the different gate driver ICs actually receive have larger difference to lead to that the charge times of the different pixel display regions corresponded with the different gate driver ICs are different. The Horizontal block (H Block) phenomenon commonly appears between the adjacent pixel display regions. Namely, there is the obvious horizontal border between the adjacent pixel display regions, which severely influences the watch experience and results in the quality descend of the liquid crystal display panel.

SUMMARY OF THE INVENTION

An objective of the present invention is to provide a drive method of a liquid crystal display panel, which can adjust the TFT activation voltage in real time so that the TFT activation voltages, which the respective gate drive ICs actually receive are consistent, and thus the charge times of the various pixel display regions are equal to eliminate the horizontal block issue and to raise the quality of the liquid crystal display panel.

Another objective of the present invention is to provide a drive system of a liquid crystal display panel, which can adjust the TFT activation voltage in real time so that the TFT activation voltages, which the respective gate drive ICs actually receive are consistent, and thus the charge times of the various pixel display regions are equal to eliminate the horizontal block issue and to raise the quality of the liquid crystal display panel.

For realizing the aforesaid objective, the present invention first provides a drive method of a liquid crystal display panel, comprising steps of:

step 1, providing a drive system of the liquid crystal display panel;

the drive system of the liquid crystal display panel comprises:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs are at least located at one side of the liquid crystal display panel, and each gate drive IC is in charge of driving the pixels of M/N rows in one pixel display region;

a PWM IC, providing a TFT activation voltage to respective gate drive ICs through wirings;

and a sequence controller electrically coupled to the PWM IC;

the sequence controller comprises a counter, a TFT activation voltage calculation module electrically coupled to the counter, an I2C instruction module electrically coupled to the TFT activation voltage calculation module and the I2C instruction module of the PWM IC;

step 2, providing an initial TFT activation voltage to the first gate drive IC correspondingly driving the first pixel display region with the PWM IC; starting to output display data to the liquid crystal display panel row by row with the sequence controller, and the counter in the sequence controller adds 1 as outputting the display data of each row;

step 3, i is set to be a positive integer, and $1 \leq i < N$, and as the counter in the sequence controller adds to $i \times M/N$, the TFT activation voltage calculation module in the sequence controller operates to obtain a target TFT activation voltage of the i+1th gate drive IC and transmits the same to the I2C instruction module, and the I2C instruction module controls the PWM IC to correspondingly output the corresponding target TFT activation voltage to the i+1th gate drive IC;

step 4, resetting the counter to zero as the counter inside the sequence controller adds to M.

The I2C instruction module and the PWM IC are electrically coupled through an I2C interface.

N gate drive ICs are also located at the other side of the liquid crystal display panel, and pixels of M/N rows of one pixel display region are commonly driven by the two gate drive ICs at the two sides of the pixel display region.

The TFT activation voltage of the i+1th gate drive IC is larger than the TFT activation voltage of the ith gate drive IC; the TFT activation voltages, which the respective gate drive ICs finally and actually receive are the same.

The present invention further provides a drive system of a liquid crystal display panel, comprising:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs are at least located at one side of the liquid crystal display panel, and each gate drive IC is in charge of driving the pixels of M/N rows in one pixel display region;

a PWM IC, providing a TFT activation voltage to respective gate drive ICs through wirings;

and a sequence controller electrically coupled to the PWM IC;

the sequence controller comprises a counter, a TFT activation voltage calculation module electrically coupled to the counter, an I2C instruction module electrically coupled to the TFT activation voltage calculation module and the I2C instruction module of the PWM IC;

the PWM IC is employed to provide an initial TFT activation voltage to the first gate drive IC and is controlled by the I2C instruction module to output respective target TFT activation voltages to other gate driver ICs; the sequence controller is employed to the output display data to the liquid crystal display panel row by row, and the counter in the sequence controller adds 1 as outputting the display data of each row; i is set to be a positive integer, and $1 \leq i < N$, and as the counter adds to $i \times M/N$, the TFT activation voltage calculation module in the sequence controller operates to obtain the target TFT activation voltage of the i+1th gate drive IC and transmits the same to the I2C instruction module, and the I2C instruction module controls the PWM IC to correspondingly output the corresponding target TFT activation voltage to the i+1th gate drive IC; the counter is reset to zero as the counter inside the sequence controller adds to M.

The I2C instruction module and the PWM IC are electrically coupled through an I2C interface.

N gate drive ICs are also located at the other side of the liquid crystal display panel, and pixels of M/N rows of one pixel display region are commonly driven by the two gate drive ICs at the two sides of the pixel display region.

Both the PWM IC and the sequence controller are located on a drive control circuit board outside the respective pixel display regions of the liquid crystal display panel.

The present invention further provides a drive method of a liquid crystal display panel, comprising steps of:

step 1, providing a drive system of the liquid crystal display panel;

the drive system of the liquid crystal display panel comprises:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs are at least located at one side of the liquid crystal display panel, and each gate drive IC is in charge of driving the pixels of M/N rows in one pixel display region;

a PWM IC, providing a TFT activation voltage to respective gate drive ICs through wirings;

and a sequence controller electrically coupled to the PWM IC;

the sequence controller comprises a counter, a TFT activation voltage calculation module electrically coupled to the counter, an I2C instruction module electrically coupled to the TFT activation voltage calculation module and the I2C instruction module of the PWM IC;

step 2, providing an initial TFT activation voltage to the first gate drive IC correspondingly driving the first pixel display region with the PWM IC; starting to output display data to the liquid crystal display panel row by row with the sequence controller, and the counter in the sequence controller adds 1 as outputting the display data of each row;

step 3, i is set to be a positive integer, and $1 \leq i < N$, and as the counter in the sequence controller adds to $i \times M/N$, the TFT activation voltage calculation module in the sequence controller operates to obtain a target TFT activation voltage of the i+1th gate drive IC and transmits the same to the I2C instruction module, and the I2C instruction module controls the PWM IC to correspondingly output the corresponding target TFT activation voltage to the i+1th gate drive IC;

step 4, resetting the counter to zero as the counter inside the sequence controller adds to M;

wherein the I2C instruction module and the PWM IC are electrically coupled through an I2C interface;

wherein the TFT activation voltage of the i+1th gate drive IC is larger than the TFT activation voltage of the ith gate drive IC; the TFT activation voltages, which the respective gate drive ICs finally and actually receive are the same.

The benefits of the present invention are: in the drive method of the liquid crystal display panel and the drive system of the liquid crystal display panel according to the present invention, the sequence controller comprises a counter, a TFT activation voltage calculation module electrically coupled to the counter and an I2C instruction module electrically coupled to the TFT activation voltage calculation module and the PWM IC, and the counter adds 1 as the sequence controller outputs the display data of each row to the liquid crystal display panel, and as adding to $i \times M/N$, the TFT activation voltage calculation module in the sequence controller operates to obtain the target TFT activation voltage of the i+1th gate drive IC and transmits the same to the I2C instruction module, and the I2C instruction module controls the PWM IC correspondingly output the corresponding target TFT activation voltage to the i+1th gate drive IC, which can adjust the TFT activation voltage in real time so that the TFT activation voltages, which the respective gate drive ICs actually receive are consistent, and thus the charge times of the various pixel display regions are equal to eliminate the horizontal block issue and to raise the quality of the liquid crystal display panel.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
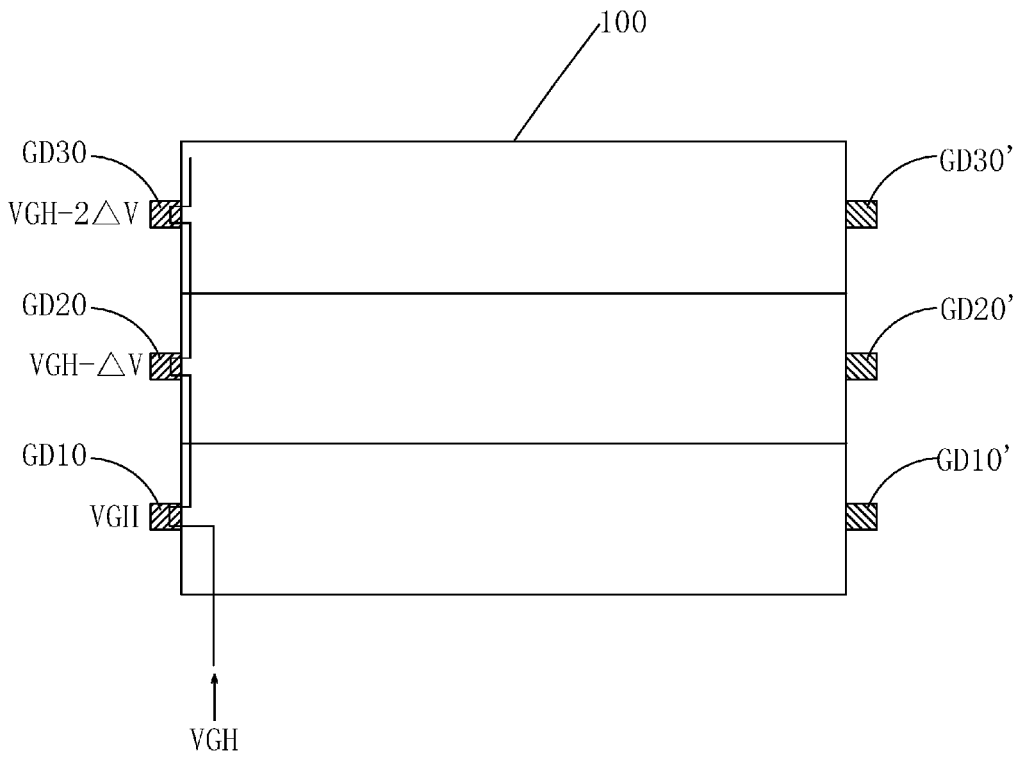
FIG. 1 is a diagram of a drive system structure of a liquid crystal display panel according to prior art.
Figure 2:
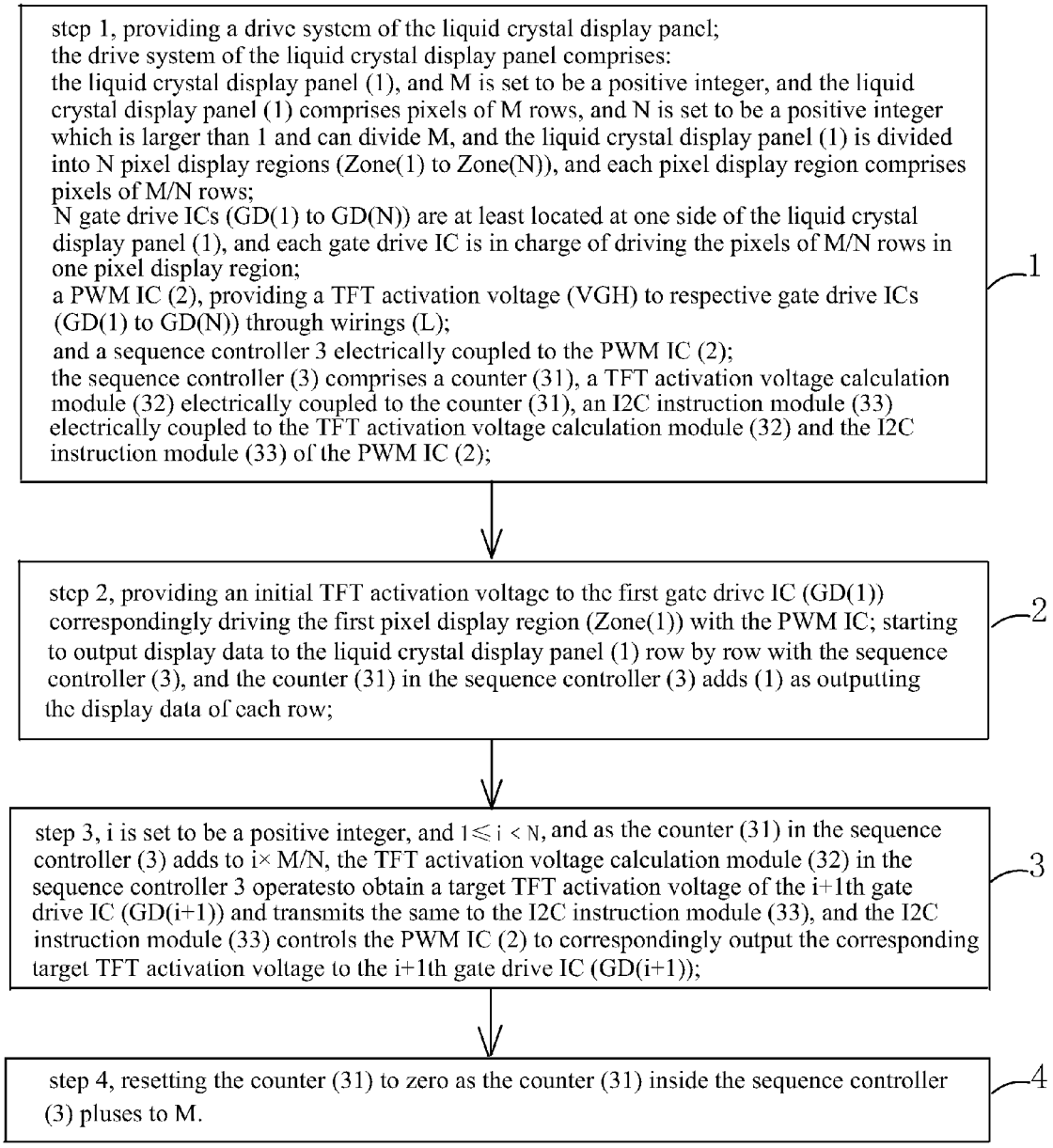
FIG. 2 is a flowchart of a drive method of a liquid crystal display panel according to the present invention.
Figure 3:
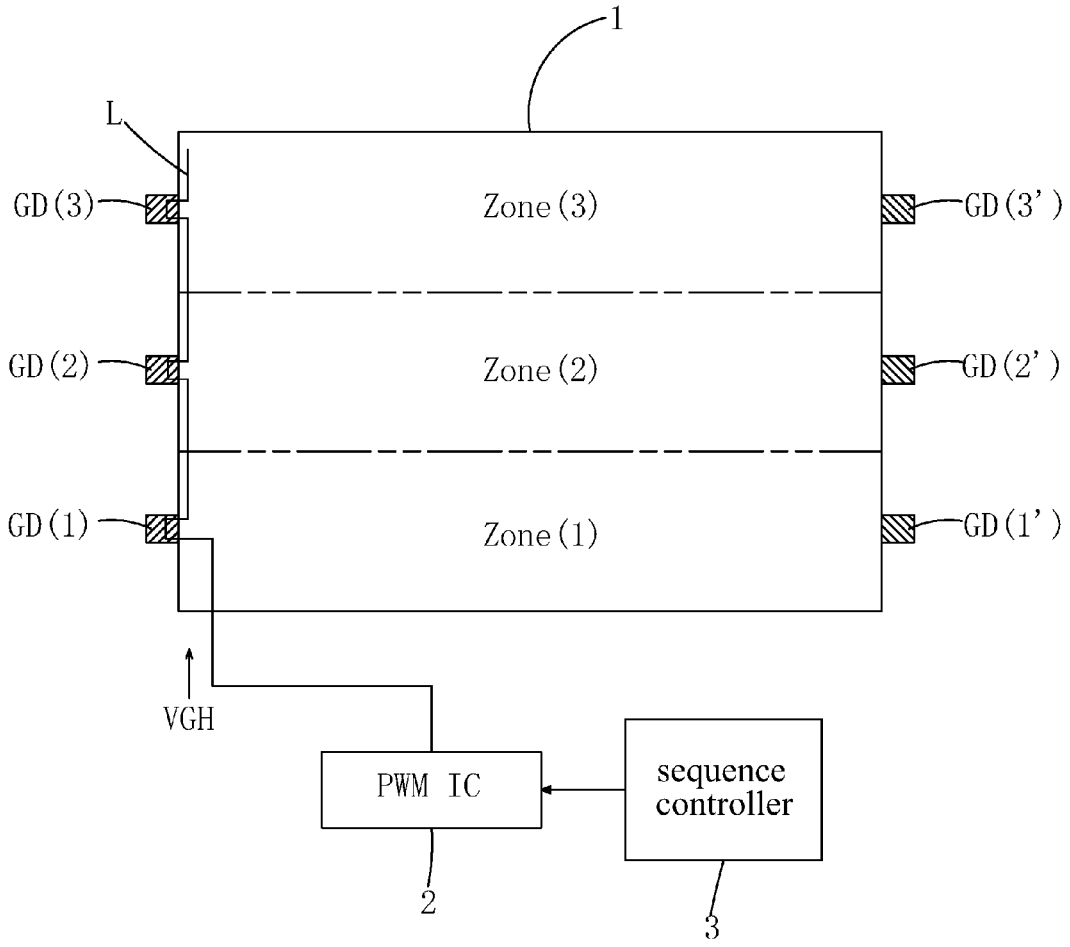
FIG. 3 is a structure diagram of a drive system of a liquid crystal display panel according to the present invention.
Figure 4:
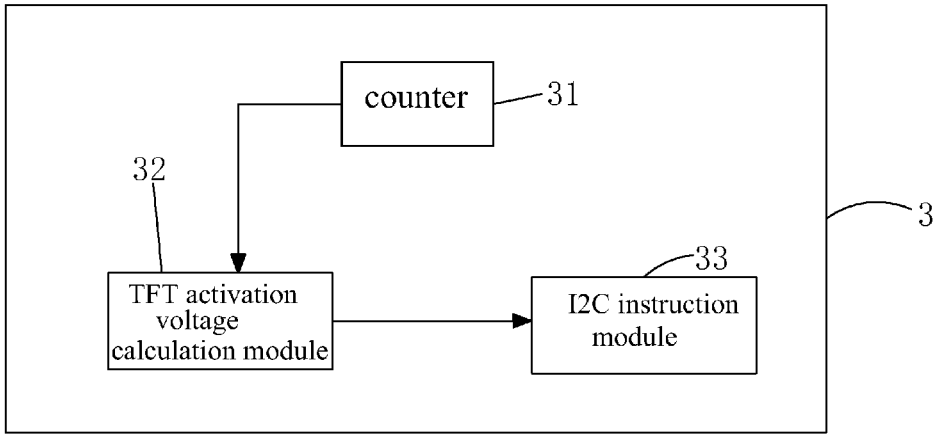
FIG. 4 is a diagram of a sequence controller in a drive system of a liquid crystal display panel according to the present invention.

Please refer to FIG. 2 in combination with FIG. 3 and FIG. 4, the present invention first provides a drive method of a liquid crystal display panel, comprising steps of:

step 1, providing a drive system of the liquid crystal display panel.

As shown in FIG. 3 and FIG. 4, the drive system of the liquid crystal display panel comprises:

the liquid crystal display panel 1, and M is set to be a positive integer, and the liquid crystal display panel 1 comprises pixels of M rows, and N is set to be a positive integer which is larger than 1 and can divide M, and the liquid crystal display panel 1 is divided into N pixel display regions Zone (1) to Zone (N), and each pixel display region comprises pixels of M/N rows;

N gate drive ICs GD(1) to GD(N) are at least located at one side of the liquid crystal display panel 1, and each gate drive IC is in charge of driving the pixels of M/N rows in one pixel display region;

a PWM IC 2, providing a TFT activation voltage VGH to respective gate drive ICs GD(1) to GD(N) through wirings L;

and a sequence controller 3 electrically coupled to the PWM IC 2; the sequence controller 3 comprises a counter 31, a TFT activation voltage calculation module 32 electrically coupled to the counter 31, an I2C instruction module 33 electrically coupled to the TFT activation voltage calculation module 32 and the I2C instruction module 33 of the PWM IC 2. Furthermore, the I2C instruction module 33 and the PWM IC 2 are electrically coupled through an I2C interface.

It is illustrated that the resolution of the liquid crystal display panel 1 is 3840×2160. The liquid crystal display panel 1 has pixels of 2160 rows, and the liquid crystal display panel 1 is divided into 3 pixel display regions Zone(1) to Zone(3), and each pixel display region comprises pixels of 720 rows. 3 gate drive ICs GD(1) to GD(3) are at least located at one side of the liquid crystal display panel 1, and each gate drive IC is in charge of driving the pixels of 720 rows in one pixel display region. Namely, the first pixel display region Zone(1) is merely driven by the first gate drive IC GD(1), and the second pixel display region Zone(2) is merely driven by the second gate drive IC GD(2), and the third pixel display region Zone(3) is merely driven by the third gate drive IC GD(3), which is applicable for the situation of single side drive of the liquid crystal display panel; certainly, 3 gate drive ICs GD(1') to GD(3') also can be located at the other side of the liquid crystal display panel 1, and pixels of 720 rows of one pixel display region are commonly driven by the two gate drive ICs at the two sides of the pixel display region. Namely, the first pixel display region Zone(1) is commonly driven by the two gate drive ICs GD(1) and GD(1') at the two sides, and the second pixel display region Zone(2) is commonly driven by the two gate drive ICs GD(2) and GD(2') at the two sides, and the third pixel display region Zone(3) is commonly driven by the two gate drive ICs GD(3) and GD(3') at the two sides, which is applicable for the situation of double sides drive of the liquid crystal display panel.

step 2, providing an initial TFT activation voltage to the first gate drive IC GD(1) (or GD(1) and GD(1')) correspondingly driving the first pixel display region Zone(1) with the PWM IC; starting to output display data to the liquid crystal display panel 1 row by row with the sequence controller 3, and the counter 31 in the sequence controller 3 adds 1 as outputting the display data of each row.

In the step 2, the first gate drive IC GD(1) (or GD(1) and GD(1')) utilizes the initial TFT activation voltage provided by the PWM IC 2 to drive the pixels of the respective rows in the first pixel display region Zone(1) for charging.

step 3, i is set to be a positive integer, and $1 \leq i < N$, and as the counter 31 in the sequence controller 3 adds to $i \times M/N$, the TFT activation voltage calculation module 32 in the sequence controller 3 operates to obtain a target TFT activation voltage of the i+1th gate drive IC GD(i+1) (or GD(i+1) and GD(i+1')) and transmits the same to the I2C instruction module 33, and the I2C instruction module 33 controls the PWM IC 2 to correspondingly output the corresponding target TFT activation voltage to the i+1th gate drive IC GD(i+1) (or GD(i+1) and GD(i+1')).

Still, it is illustrated that the resolution of the liquid crystal display panel 1 is 3840×2160. As the counter 31 adds to 720, it means that the third pixel display region Zone(1), of which the gate drive ICs GD(1) and GD(1') are in charge, has already been charged, and the TFT activation voltage calculation module 32 operates to obtain the target TFT activation voltage of the second gate drive ICs GD(2) and GD(2') and transmits the same to the I2C instruction module 33, and the I2C instruction module 33 controls the PWM IC 2 through the I2C interface to correspondingly output the corresponding target TFT activation voltage to the second gate drive ICs GD(2) and GD(2').

Similarly, as the counter 31 adds to 1440, it means that the third pixel display region Zone(2), of which the gate drive ICs GD(2) and GD(2') are in charge, has already been charged, and the TFT activation voltage calculation module 32 operates to obtain the target TFT activation voltage of the second gate drive ICs GD(3) and GD(3') and transmits the same to the I2C instruction module 33, and the I2C instruction module 33 controls the PWM IC 2 through the I2C interface to correspondingly output the corresponding target TFT activation voltage to the second gate drive ICs GD(3) and GD(3').

and so on.

Specifically, that the TFT activation voltage calculation module 32 operates the target TFT activation voltages of the respective gate drive ICs is based on: under the situation of providing the initial TFT activation voltage to all the respective gate drive ICs of the same liquid crystal display panel 1, the TFT activation voltage decay amplitude between the two adjacent gate drive ICs is practically measured to obtain a preset compensation value. Then, the internal related registers of the sequence controller 3 is set, and because the decay of the TFT activation voltage on the wiring L is linear, the increased amplitude of the target activation voltage should be linear, too. As the counter 31 in the sequence controller 3 adds to i×M/N each time, the TFT activation voltage calculation module 32 can operates the target TFT activation voltages of the respective gate drive ICs by modulating the preset compensation value of the corresponding multiple.

step 4, resetting the counter 31 to zero as the counter 31 inside the sequence controller 3 adds to M.

Still, it is illustrated that the resolution of the liquid crystal display panel 1 is 3840×2160. As the counter 31 adds to 2160, it means that the third pixel display region Zone(3), of which the gate drive ICs GD(3) and GD(3') are in charge, has already been charged, and the counter 31 is reset to zero to enter the drive and display of the next frame of image.

Figure 5:
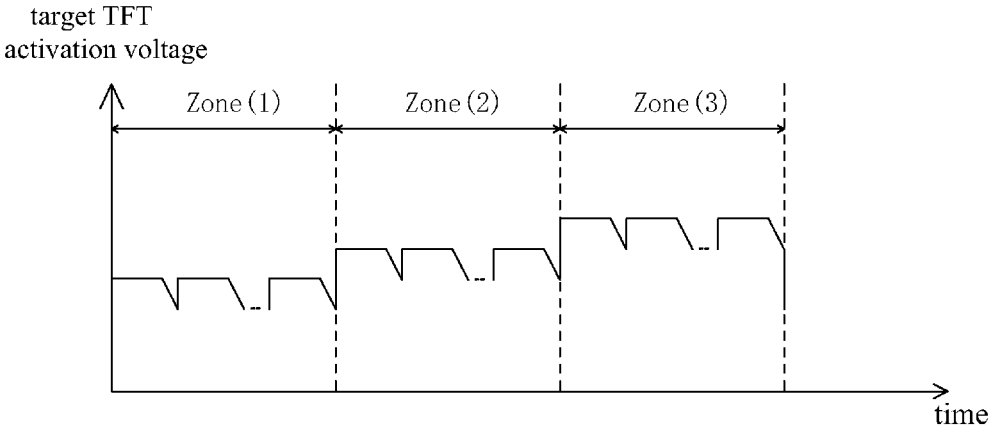
FIG. 5 is a waveform diagram of the target TFT activation voltages of the respective gate drive ICs in the driving method of the liquid crystal display panel according to the present invention.

As shown in FIG. 5, the target TFT activation voltage of the i+1th gate drive ICs GD(i+1) (or GD(i+1) and GD(i+1')) correspondingly driving the i+1th pixel display region Zone (i+1), which is provided after the operation of the TFT activation voltage calculation module 32 is larger than the target TFT activation voltage of the ith gate drive ICs GD(i) (or GD(i) and GD(i')) correspondingly driving the ith pixel display region Zone(i). However, liner decay exists as the TFT activation voltage is transmitted on the wiring, the TFT activation voltages, which the respective gate drive ICs GD(1) to GD(N) (or GD(1) to GD(N) and GD(1') to GD(N')) finally and actually receive are the same, which realizes the adjustment of the TFT activation voltage in time so that the charge times of the various pixel display regions are equal to eliminate the horizontal block issue and to raise the quality of the liquid crystal display panel.

Please refer to FIG. 3 and FIG. 4. On the basis of the same inventive idea, the present invention further provides a drive system of a liquid crystal display panel, comprising:

the liquid crystal display panel 1, and M is set to be a positive integer, and the liquid crystal display panel 1 comprises pixels of M rows, and N is set to be a positive integer which is larger than 1 and can divide M, and the liquid crystal display panel 1 is divided into N pixel display regions Zone (1) to Zone (N), and each pixel display region comprises pixels of M/N rows;

N gate drive ICs GD(1) to GD(N) are at least located at one side of the liquid crystal display panel 1, and each gate drive IC is in charge of driving the pixels of M/N rows in one pixel display region;

a PWM IC 2, providing a TFT activation voltage VGH to respective gate drive ICs GD(1) to GD(N) through wirings L;

and a sequence controller 3 electrically coupled to the PWM IC 2; the sequence controller 3 comprises a counter 31, a TFT activation voltage calculation module 32 electrically coupled to the counter 31, an I2C instruction module 33 electrically coupled to the TFT activation voltage calculation module 32 and the I2C instruction module 33 of the PWM IC 2. Furthermore, the I2C instruction module 33 and the PWM IC 2 are electrically coupled through an I2C interface.

Specifically, both the PWM IC 2 and the sequence controller 3 are located on a drive control circuit board (CB) outside the respective pixel display regions of the liquid crystal display panel 1.

It is illustrated that the resolution of the liquid crystal display panel 1 is 3840×2160. The liquid crystal display panel 1 has pixels of 2160 rows, and the liquid crystal display panel 1 is divided into 3 pixel display regions Zone(1) to Zone(3), and each pixel display region comprises pixels of 720 rows. 3 gate drive ICs GD(1) to GD(3) are at least located at one side of the liquid crystal display panel 1, and each gate drive IC is in charge of driving the pixels of 720 rows in one pixel display region. Namely, the first pixel display region Zone(1) is merely driven by the first gate drive IC GD(1), and the second pixel display region Zone(2) is merely driven by the second gate drive IC GD(2), and the third pixel display region Zone(3) is merely driven by the third gate drive IC GD(3), which is applicable for the situation of single side drive of the liquid crystal display panel; certainly, 3 gate drive ICs GD(1') to GD(3') also can be located at the other side of the liquid crystal display panel 1, and pixels of 720 rows of one pixel display region are commonly driven by the two gate drive ICs at the two sides of the pixel display region. Namely, the first pixel display region Zone(1) is commonly driven by the two gate drive ICs GD(1) and GD(1') at the two sides, and the second pixel display region Zone(2) is commonly driven by the two gate drive ICs GD(2) and GD(2') at the two sides, and the third pixel display region Zone(3) is commonly driven by the two gate drive ICs GD(3) and GD(3') at the two sides, which is applicable for the situation of double sides drive of the liquid crystal display panel.

The PWM IC 2 is employed to provide an initial TFT activation voltage to the first gate drive IC GD(1) and is controlled by the I2C instruction module 33 to output respective target TFT activation voltages to other gate driver ICs GD(2) to GD(N) (or GD(2) to GD(N) and GD(2') to GD(N')); the sequence controller 3 is employed to the output display data to the liquid crystal display panel 1 row by row, and the counter 31 in the sequence controller 3 adds 1 as outputting the display data of each row; i is set to be a positive integer, and 1≤i<N, and as the counter 31 adds to i×M/N each time, the TFT activation voltage calculation module 32 in the sequence controller 3 operates to obtain the target TFT activation voltage of the i+1th gate drive IC GD(i+1) (or GD(i+1) and GD(i+1')) and transmits the same to the I2C instruction module 33, and the I2C instruction module 33 controls the PWM IC 2 to correspondingly output the corresponding target TFT activation voltage to the i+1th gate drive IC GD(i+1) (or GD(i+1) and GD(i+1')); the counter 31 is reset to zero as the counter 31 inside the sequence controller 3 adds to M.

Still, it is illustrated that the resolution of the liquid crystal display panel 1 is 3840×2160, and the working procedure of the liquid crystal display panel is:

First, the first gate drive IC GD(1) (or GD(1) and GD(1')) utilizes the initial TFT activation voltage provided by the PWM IC 2 to drive the pixels of the respective rows in the first pixel display region Zone(1) for charging. The counter 31 in the sequence controller 3 adds 1 as the sequence controller 3 outputs the display data of each row.

As the counter 31 adds to 720, it means that the third pixel display region Zone(1), of which the gate drive ICs GD(1) and GD(1') are in charge, has already been charged, and the TFT activation voltage calculation module 32 operates to obtain the target TFT activation voltage of the second gate drive ICs GD(2) and GD(2') and transmits the same to the I2C instruction module 33, and the I2C instruction module 33 controls the PWM IC 2 through the I2C interface to correspondingly output the corresponding target TFT activation voltage to the second gate drive ICs GD(2) and GD(2').

Similarly, as the counter 31 adds to 1440, it means that the third pixel display region Zone(2), of which the gate drive ICs GD(2) and GD(2') are in charge, has already been charged, and the TFT activation voltage calculation module 32 operates to obtain the target TFT activation voltage of the second gate drive ICs GD(3) and GD(3') and transmits the same to the I2C instruction module 33, and the I2C instruction module 33 controls the PWM IC 2 through the I2C interface to correspondingly output the corresponding target TFT activation voltage to the second gate drive ICs GD(3) and GD(3').

and so on.

As the counter 31 adds to 2160, it means that the third pixel display region Zone(3), of which the gate drive ICs GD(3) and GD(3') are in charge, has already been charged, and the counter 31 is reset to zero to enter the drive and display of the next frame of image.

Significantly, that the TFT activation voltage calculation module 32 operates the target TFT activation voltages of the respective gate drive ICs is based on: under the situation of providing the initial TFT activation voltage to all the respective gate drive ICs of the same liquid crystal display panel 1, the TFT activation voltage decay amplitude between the two adjacent gate drive ICs is practically measured to obtain a preset compensation value. Then, the internal related registers of the sequence controller 3 is set, and because the decay of the TFT activation voltage on the wiring L is linear, the increased amplitude of the target activation voltage should be linear, too. As the counter 31 in the sequence controller 3 adds to i×M/N each time, the TFT activation voltage calculation module 32 can operates the target TFT activation voltages of the respective gate drive ICs by modulating the preset compensation value of the corresponding multiple.

As shown in FIG. 5, the target TFT activation voltage of the i+1th gate drive ICs GD(i+1) (or GD(i+1) and GD(i+1')) correspondingly driving the i+1th pixel display region Zone (i+1), which is provided after the operation of the TFT activation voltage calculation module 32 is larger than the target TFT activation voltage of the ith gate drive ICs GD(i) (or GD(i) and GD(i')) correspondingly driving the ith pixel display region Zone(i). However, liner decay exists as the TFT activation voltage is transmitted on the wiring, the TFT activation voltages, which the respective gate drive ICs GD(1) to GD(N) (or GD(1) to GD(N) and GD(1') to GD(N')) finally and actually receive are the same, which realizes the adjustment of the TFT activation voltage in time so that the charge times of the various pixel display regions are equal to eliminate the horizontal block issue and to raise the quality of the liquid crystal display panel.

In conclusion, in the drive method of the liquid crystal display panel and the drive system of the liquid crystal display panel according to the present invention, the sequence controller comprises a counter, a TFT activation voltage calculation module electrically coupled to the counter and an I2C instruction module electrically coupled to the TFT activation voltage calculation module and the PWM IC, and the counter adds 1 as the sequence controller outputs the display data of each row to the liquid crystal display panel, and as adding to i×M/N, the TFT activation voltage calculation module in the sequence controller operates to obtain the target TFT activation voltage of the i+1th gate drive IC and transmits the same to the I2C instruction module, and the I2C instruction module controls the PWM IC correspondingly output the corresponding target TFT activation voltage to the i+1th gate drive IC, which can adjust the TFT activation voltage in real time so that the TFT activation voltages, which the respective gate drive ICs actually receive are consistent, and thus the charge times of the various pixel display regions are equal to eliminate the horizontal block issue and to raise the quality of the liquid crystal display panel.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A drive method of a liquid crystal display panel, comprising steps of:

step 1, providing a drive system of the liquid crystal display panel;

the drive system of the liquid crystal display panel comprises:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs are at least located at one side of the liquid crystal display panel, and each gate drive IC is in charge of driving the pixels of M/N rows in one pixel display region;

a PWM IC, providing a TFT activation voltage to respective gate drive ICs through wirings;

and a sequence controller electrically coupled to the PWM IC;

the sequence controller comprises a counter, a TFT activation voltage calculation module electrically coupled to the counter, an I2C instruction module electrically coupled to the TFT activation voltage calculation module and the I2C instruction module of the PWM IC;

step 2, providing an initial TFT activation voltage to the first gate drive IC correspondingly driving the first pixel display region with the PWM IC; starting to output display data to the liquid crystal display panel row by row with the sequence controller, and the counter in the sequence controller adds 1 as outputting the display data of each row;

step 3, i is set to be a positive integer, and $1 \leq i < N$, and as the counter in the sequence controller adds to i×M/N, the TFT activation voltage calculation module in the sequence controller operates to obtain a target TFT activation voltage of the i+1th gate drive IC and transmits the same to the I2C instruction module, and the I2C instruction module controls the PWM IC to correspondingly output the corresponding target TFT activation voltage to the i+1th gate drive IC;

step 4, resetting the counter to zero as the counter inside the sequence controller adds to M.

2. The driving method of the liquid crystal display panel according to claim 1, wherein the I2C instruction module and the PWM IC are electrically coupled through an I2C interface.

3. The drive method of the liquid crystal display panel according to claim 1, wherein N gate drive ICs are also located at the other side of the liquid crystal display panel, and pixels of M/N rows of one pixel display region are commonly driven by the two gate drive ICs at the two sides of the pixel display region.

4. The drive method of the liquid crystal display panel according to claim 1, wherein the TFT activation voltage of the i+1th gate drive IC is larger than the TFT activation voltage of the ith gate drive IC; the TFT activation voltages, which the respective gate drive ICs finally and actually receive are the same.

5. A drive system of a liquid crystal display panel, comprising:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs are at least located at one side of the liquid crystal display panel, and each gate drive IC is in charge of driving the pixels of M/N rows in one pixel display region;

a PWM IC, providing a TFT activation voltage to respective gate drive ICs through wirings;

and a sequence controller electrically coupled to the PWM IC;

the sequence controller comprises a counter, a TFT activation voltage calculation module electrically coupled to the counter, an I2C instruction module electrically coupled to the TFT activation voltage calculation module and the I2C instruction module of the PWM IC;

the PWM IC is employed to provide an initial TFT activation voltage to the first gate drive IC and is controlled by the I2C instruction module to output respective target TFT activation voltages to other gate driver ICs; the sequence controller is employed to the output display data to the liquid crystal display panel row by row, and the counter in the sequence controller adds 1 as outputting the display data of each row; i is set to be a positive integer, and $1 \leq i < N$, and as the counter adds to $i \times M/N$, the TFT activation voltage calculation module in the sequence controller operates to obtain the target TFT activation voltage of the i+1th gate drive IC and transmits the same to the I2C instruction module, and the I2C instruction module controls the PWM IC to correspondingly output the corresponding target TFT activation voltage to the i+1th gate drive IC; the counter is reset to zero as the counter inside the sequence controller adds to M.

6. The driving system of the liquid crystal display panel according to claim 5, wherein the I2C instruction module and the PWM IC are electrically coupled through an I2C interface.

7. The drive system of the liquid crystal display panel according to claim 5, wherein N gate drive ICs are also located at the other side of the liquid crystal display panel, and pixels of M/N rows of one pixel display region are commonly driven by the two gate drive ICs at the two sides of the pixel display region.

8. The drive system of the liquid crystal display panel according to claim 5, wherein both the PWM IC and the sequence controller are located on a drive control circuit board outside the respective pixel display regions of the liquid crystal display panel.

9. A drive method of a liquid crystal display panel, comprising steps of:

step 1, providing a drive system of the liquid crystal display panel;

the drive system of the liquid crystal display panel comprises:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs are at least located at one side of the liquid crystal display panel, and each gate drive IC is in charge of driving the pixels of M/N rows in one pixel display region;

a PWM IC, providing a TFT activation voltage to respective gate drive ICs through wirings;

and a sequence controller electrically coupled to the PWM IC;

the sequence controller comprises a counter, a TFT activation voltage calculation module electrically coupled to the counter, an I2C instruction module electrically coupled to the TFT activation voltage calculation module and the I2C instruction module of the PWM IC;

step 2, providing an initial TFT activation voltage to the first gate drive IC correspondingly driving the first pixel display region with the PWM IC; starting to output display data to the liquid crystal display panel row by row with the sequence controller, and the counter in the sequence controller adds 1 as outputting the display data of each row;

step 3, i is set to be a positive integer, and $1 \leq i < N$, and as the counter in the sequence controller adds to $i \times M/N$, the TFT activation voltage calculation module in the sequence controller operates to obtain a target TFT activation voltage of the i+1th gate drive IC and transmits the same to the I2C instruction module, and the I2C instruction module controls the PWM IC to correspondingly output the corresponding target TFT activation voltage to the i+1th gate drive IC;

step 4, resetting the counter to zero as the counter inside the sequence controller adds to M;

wherein the I2C instruction module and the PWM IC are electrically coupled through an I2C interface;

wherein the TFT activation voltage of the i+1th gate drive IC is larger than the TFT activation voltage of the ith gate drive IC; the TFT activation voltages, which the respective gate drive ICs finally and actually receive are the same.

10. The drive method of the liquid crystal display panel according to claim 9, wherein N gate drive ICs are also located at the other side of the liquid crystal display panel, and pixels of M/N rows of one pixel display region are commonly driven by the two gate drive ICs at the two sides of the pixel display region.

* * * * *